US005737792A

United States Patent [19]

Quigless

[11] Patent Number: 5,737,792

[45] Date of Patent: Apr. 14, 1998

[54] DISPENSABLE-HEAD MANUAL TOOTHBRUSH AND DISPENSER COMBINATION

[76] Inventor: Kirk Quigless, 46 Lewis, St. Louis, Mo. 63113

[21] Appl. No.: 720,473

[22] Filed: Sep. 30, 1996

[51] Int. Cl.[6] ..... A46B 9/04

[52] U.S. Cl. ..... 15/167.1; 15/145; 15/167.1; 15/176.6; 29/450; 132/310

[58] Field of Search ..... 15/145, 167.1, 15/176.1, 176.6, 184; 29/450; 132/308, 310, 311; 206/362.1, 362.2, 362.3

[56] References Cited

U.S. PATENT DOCUMENTS

| | | | |
|---|---|---|---|
| 1,797,946 | 3/1931 | Eichel . | |
| 1,800,993 | 4/1931 | Funk . | |
| 1,908,510 | 5/1933 | Dodson . | |
| 1,910,304 | 5/1933 | McKinley . | |
| 1,947,720 | 2/1934 | Laub . | |
| 2,225,331 | 12/1940 | Campbell . | |
| 2,517,029 | 8/1950 | Ridner, Sr. . | |
| 2,618,003 | 11/1952 | Robey . | |
| 3,103,680 | 9/1963 | Krichmar . | |
| 4,362,174 | 12/1982 | Baker et al. | 15/176.1 |
| 4,411,041 | 10/1983 | Braga . | |
| 4,543,679 | 10/1985 | Rosofsky . | |
| 4,754,516 | 7/1988 | Tremblay | 15/176.6 |
| 4,890,349 | 1/1990 | Nitzsche . | |
| 4,890,732 | 1/1990 | Shackelford | 15/167.1 |
| 5,005,246 | 4/1991 | Yen-Hui . | |
| 5,247,716 | 9/1993 | Bock . | |
| 5,369,831 | 12/1994 | Bock . | |
| 5,412,831 | 5/1995 | Mongelluzzo | 15/716.1 |
| 5,615,443 | 4/1997 | Lai | 15/176.1 |

*Primary Examiner*—Terrence Till
*Attorney, Agent, or Firm*—Veo Peoples, Jr.; Peoples & Hale

[57] ABSTRACT

A dispensable-head toothbrush and dispenser combination comprising (1) a handle, squeezable along its longitudinal axis, having a large end opposite of a narrow tongue-like member, which are both dimensionally reduced when squeezing said handle at its large end; and (2) a plurality of hollow dispensable toothbrush heads, each having an opening for receiving and releasably engaging said tongue means of the handle; and (3) a toothbrush head dispenser having individual compartments in which each one of the plurality of heads rest so as to expose the opening in said heads to having the tongue means of the handle inserted there into.

9 Claims, 2 Drawing Sheets

DISPENSABLE-HEAD MANUAL TOOTHBRUSH AND DISPENSER COMBINATION

BACKGROUND OF INVENTION

1. Field of Invention

This invention relates to manual toothbrushes of the type having dispensable or replaceable heads. It particularly relates to hygienic improvements in the construction of such toothbrushes and in the methods for assembling them.

2. Background of Prior Art

Manual toothbrushes with replaceable brush heads have been previously proposed. With such toothbrushes it is possible to exchange different brush heads while retaining the same handle piece. A plethora of design options have been available. Those options have included, for example, the head part of the handle having a dove-tail or tongue-shaped "male" part which is inserted into an appropriately shaped recess of the brush head to clamp or lock in the male insert; as well as options where the "male" part is made on the brush head and locks into a recess in the handle. Also, there have been designs for sliding, clamping, and even snapping the replaceable head onto the handle.

Various means have been proposed for locking/releasing the head and handle by positive force or friction.

Although replaceable toothbrush heads, which can be discarded after each brushing, offer great hygienic improvement over normal one-piece toothbrushes, several drawbacks have inhibited the commercialization of such toothbrushes. Most modern day modifications have dealt with either (1) design modification to minimize the number of surfaces and/or appendages on the head of the toothbrush which otherwise favor the collection of bacteria and thus lower the level of hygiene which can be achieved, or (2) such improvements deal with refining the various locking mechanisms. These modifications have not been cost effective.

The prior art, until now, has presumed that for manual replaceable-head toothbrushes, the user must hold the individual replaceable-head in one hand and either assemble or disassemble the handle with the other hand. It is my proposal that this assembly and/or disassembly of the replaceable-head by holding it with the human hand provides an initial risk of contamination which, if eliminated, can provide cost-effective design and superior hygiene.

An effective means for negating the need to assemble and/or disassemble, by hand, the head and handle of a replaceable head toothbrush would represent a novel and surprisingly effective advancement in the art.

It is therefore a principle object of the present invention to hygienically improve the overall use and handling of replaceable-head toothbrushes.

It is a further principle object of the invention to provide an improved dispensable-head toothbrush combination with a novel handle.

SUMMARY OF THE INVENTION

These objects and others, which will become readily apparent from the detailed description, are fulfilled by the combination of a. a novel toothbrush handle, which is resiliently squeezable towards its longitudinal axis so as to dimensionally reduce one end of the handle which forms a tongue-like member; and b. a hollow dispensable-toothbrush head having a base which is open at one end, forming a contoured channel for detachably receiving and releasably engaging the tongue-like member of the handle, said channel being wholly contained within the base; and c. a dispenser for storing a plurality of the dispensable heads in a fashion that permits the assembly of the handle with one of the plurality of dispensable heads, but without the user having to touch or hold that dispensable head with his or her free hand.

DETAILED DESCRIPTION OF THE PREFERRED EMBODIMENTS

Figure 1:
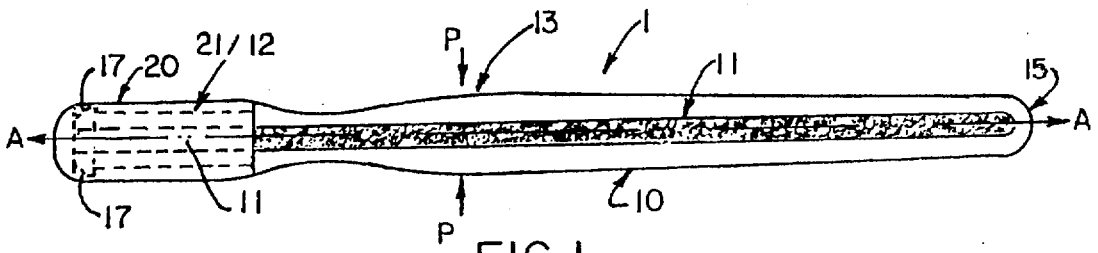
FIG. 1 shows an assembled toothbrush seen from the top, according to the preferred embodiment of the invention.
Figure 2:
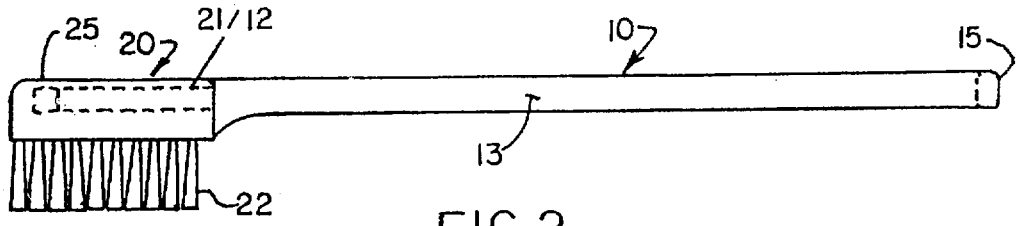
FIG. 2 shows an assembled toothbrush seen from the front, according to the preferred embodiment of the invention.
Figure 3:
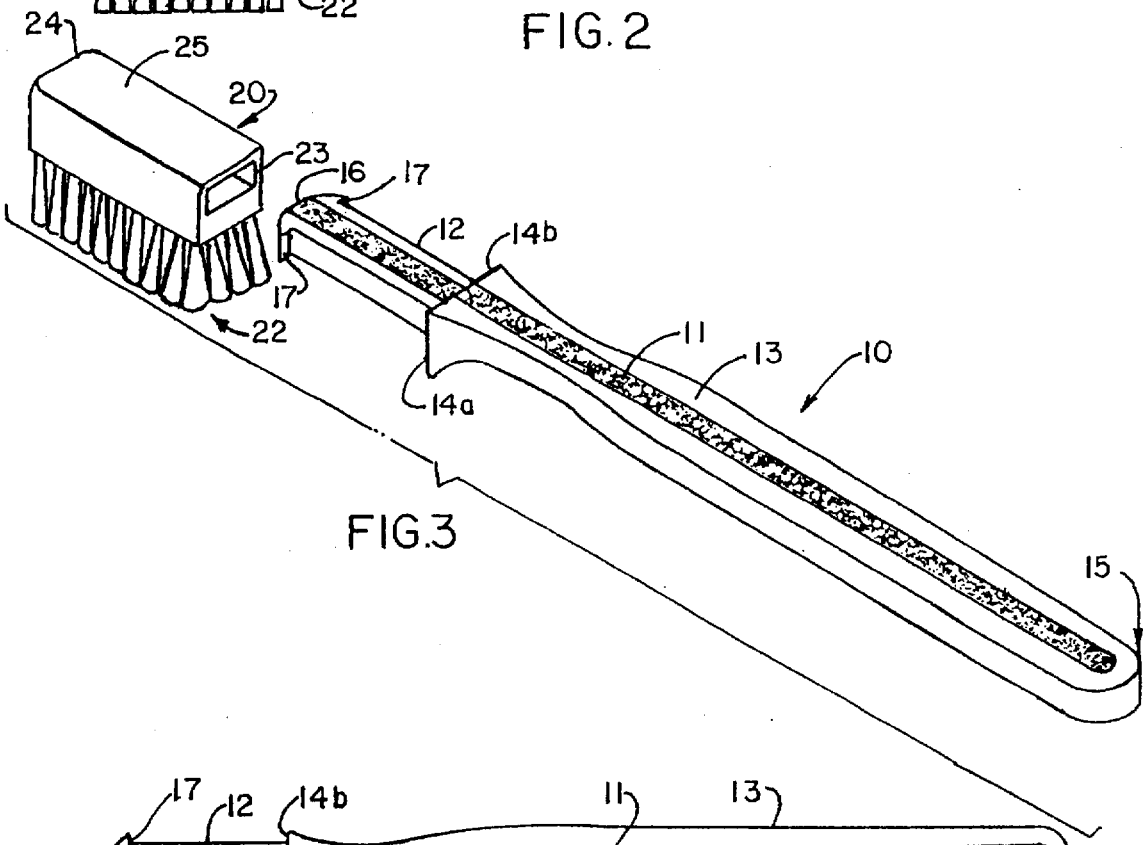
FIG. 3 shows a perspective view of the dispensable-head and the handle prior to assembly of the toothbrush according to the preferred embodiment of the invention.
Figure 4:
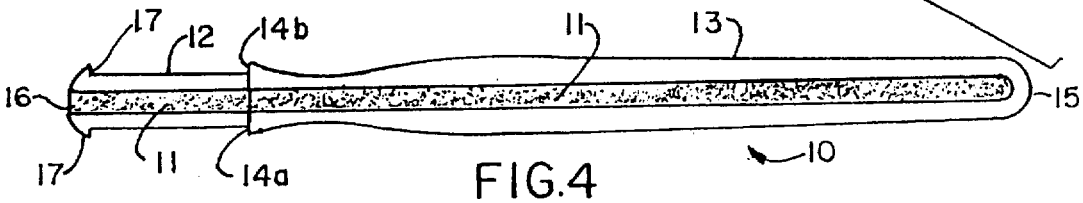
FIG. 4 shows a top view of the handle of the toothbrush according to the preferred embodiment of the invention.
Figure 5:
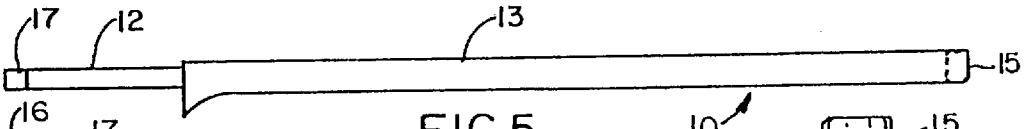
FIG. 5 shows a front view of the handle of FIG. 4.
Figure 6:
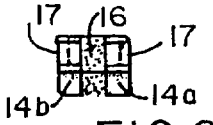
FIG. 6 shows a left end view of the handle of FIGS. 4 and 5.
Figure 7:
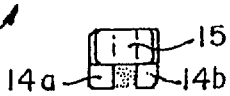
FIG. 7 shows a right end view of the handle of FIGS. 4 and 5.
Figure 8:
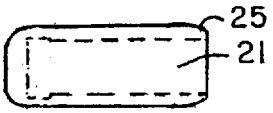
FIG. 8 shows a top view of the dispensable-head of the toothbrush according to the preferred embodiment of the invention.
Figure 11:
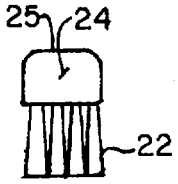
FIG. 11 shows a left end view of FIG. 8.
Figure 9:
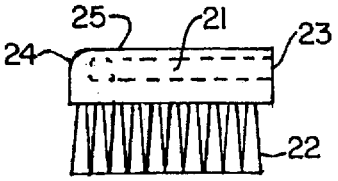
FIG. 9 shows a front view of FIG. 8.
Figure 12:
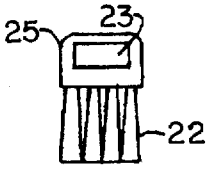
FIG. 12 shows a right end view of FIG. 8.
Figure 10:
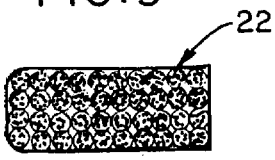
FIG. 10 shows a bottom view of FIG. 8.

By referring generally to FIGS. 1 through 3, a preferred embodiment of the present invention may be seen to comprise a dispensable-head toothbrush (1).

By referring further to FIG. 4 through FIG. 7, a component of the toothbrush (1) may be seen to comprise generally, as a preferred embodiment thereof, an improved handle member (10).

By referring still further to FIGS. 8 through 12, another preferred component embodiment of the toothbrush (1) may be seen to comprise generally a dispensable head (20).

Figure 13:
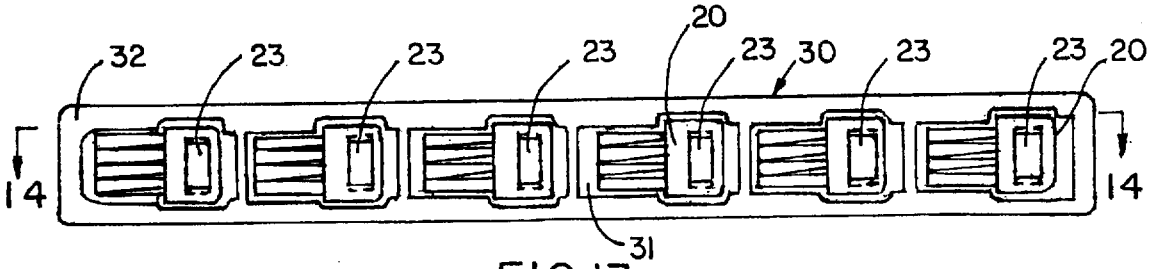
FIG. 13 shows a top view of a plurality of dispensable-heads for the toothbrush, resting in a dispenser, according to a preferred embodiment of the invention.
Figure 14:
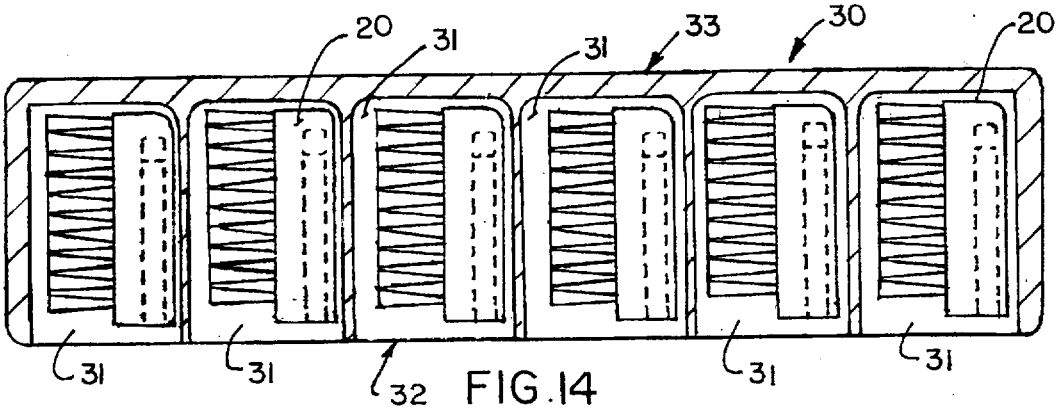
FIG. 14 shows a back cross-sectional view along 14—14 of FIG. 13.

Finally, by referring generally to FIGS. 13 and 14, the present invention may be seen to further comprise in addition to the handle member (10) and the dispensable heads (20), the dispenser (30) for storing a plurality of dispensable heads (20) and for facilitating the assembly of the toothbrush (1).

The detailed embodiments of the toothbrush-dispenser combination and the method of the present invention will become more fully understood from the discussion below which should be read in concert with the appropriate figures as described above.

The toothbrush handle (10) as a preferred embodiment of the present invention comprises a first contoured end (12). This first end (12) may be defined as a short narrow tongue means. It may be contoured in any of several shapes so long as it is compatible with, and conforms to, its insertion into the dispensable head (20). The first end (12) is affixed to, and extends from, a second end (13) which may be defined as a long broader-hand-hold means. It is critical that the handle (10) be squeezable towards the longitudinal axis A—A shown in FIG. 1 by asserting pressure at P—P of the second end (13). In a particularly preferred embodiment of the invention, the handle (1) is generally constructed of plastic material having the rigidity and stiffness of conventional toothbrush handles. However, the plastic material handle (1) is configured in a U-shape, bending at (15) and having its upright U-type prongs shown generally at (17) for first end (12) which extend from upright prongs 14*a* and 14*b* of second end (13) at the interface between ends (12) and (13). A soft resilient interior material filling (11) such as squeezable foam may be affixed throughout the core of handle (10), said core being defined as the space between the prongs (17) and the prongs 14*a* and 14*b*. Thus, when squeezed, for example, at P—P, short end (12) will be dimensionally reduced, particularly at its width (16). The toothbrush handle is therefore constructed to be withdrawably insertable into and releasably engageable within a suitably designed toothbrush head upon the action of squeezing the handle.

In accordance with the combination of the present invention, there is also provided a plurality of hollow, dispensable toothbrush heads (20), which rest in a dispenser (30). Each head (20) is defined by a base member (25) from which bristles (22) extend in the normal fashion. The base member (25) contains a hollow internal mouth channel (21) which is shaped to the contour of the short narrow tongue means of first end (12) of the handle (10). The tongue means at end (12) can accordingly be releasably engaged (such engagement is shown at 21/12) into the internal mouth channel (21) by squeezing handle (10) at P—P, and inserting tip (16) of handle (10) through opening (23) of the one end of dispensable-head (20) which is opposite of end (24), followed by releasing pressure or cessation of squeezing at P—P. This effectively assembles the toothbrush. Disassembly comprises re-squeezing at P—P, which again dimensionally reduces end (16) of the handle, and removing the handle.

It is particularly preferred that the plurality of heads (20) rest in individual compartments (31) of a multicompartment dispenser (30) so as to expose openings (23) at surface (32) of the dispenser, which surface is also open. Accordingly, the method of assembling toothbrush (1) comprises inserting or projecting the first, short end or tongue means (12) at its tip (16), while it is dimensionally reduced at (16) into the opening (23) of any one of the heads (20), and while said individual head (20) rests in individual compartment (31), in a position as previously described. Note that open surface (32) of the dispenser (30) is opposite of a closed surface (33) shown at FIG. 14. A cover of compatible construction for hermetically sealing open surface (32) is contemplated even though not shown.

In a particularly preferred embodiment of the invention, the material of construction for the toothbrush, particularly its dispensable head, can be biodegradable, and, thus, disposable.

It is a particularly preferred embodiment of the invention that the resiliently squeezable handle (10) is a multi-walled structure, rectangularly designed to dimensionally reduce its tongue means (12) while squeezing in only one direction (P—P), i.e., parallel to the plane of the brushing surface. This affords the convenience of holding the handle as tightly as desired, in a direction perpendicular to the plane of brushing. Thus, the user can brush while gripping the plane of the handle perpendicular to the brushing surface without risk of disengaging the handle from the brush head. Although such design and method of use is particularly preferred, it is not necessarily critical. For example, one could also use the handle by gripping it parallel to plane of brushing but being careful not to grip it so tightly that the brush disassembles. Alternatively, for example, a cylindrically shaped hollow handle could be constructed with resilient walls. Such construction includes a material having sufficient stiffness to be gripped while brushing without any dimensional reduction or deformation of its walls. Yet, it would have sufficient elasticity to permit effectively disengaging deformation when squeezing at a pressure in excess of that necessarily required for hand-held brushing; and then, springing back into the original dimensions, upon the release of such pressure.

It will be apparent from the above-described detailed description of preferred embodiments that the combination, although novel, is illustrative of alternatives which come within the inventive scope of the present invention. Modifications, additions, substitutions and deletions, not specifically described, may therefore be made without departing from the spirit and scope of the invention as defined in the appended claims.

What is claimed is:

1. An improved dispensable-head manual toothbrush and dispenser combination comprising:

a. a toothbrush handle, resiliently squeezable towards a longitudinal axis, said handle extending from a first contoured end which forms a short, narrow tongue means, to a second end which forms a long, broader-hand hold means; and b. a plurality of hollow dispensable toothbrush heads, each head having bristles extending from a base member, said base member having a hollow internal mouth channel being wholly contained within the base but open at one end of the base, said mouth channel being shaped to a contour of the first contoured end of the handle so as to (i) detachably receive the short narrow tongue means of the first contoured end of the handle when said handle is squeezed along its longitudinal axis, at its second end, and (ii) to releasably engage said tongue means when the handle is not squeezed; and c. a toothbrush head dispenser means having individual compartments in which each of the plurality of toothbrush heads rest, said compartments being open at one end for receiving and dispensing each individual toothbrush head, said toothbrush heads resting in said compartments so as to expose the opening in the base of the head for receiving the handle, whereby the toothbrush may be assembled by squeezing the handle and inserting the handle's tongue means into the opening of a dispensable head, while said head rests within a compartment of the dispenser.

2. A method for assembling a dispensable-head toothbrush comprising:

a. providing a handle member having a large end, squeezing the large end of the handle member, which member has a tongue means extending from the large end, said squeezing serving to dimensionally reduce the tongue means; and b. providing a multicompartment dispenser having a dispensable-head member located in an open compartment, the dispensable-head member having an opening, inserting the tongue means of said handle member into the opening of the dispensable-head member while said member rests in the open compartment of the multicompartment dispenser, so as to releasably engage the handle to the head upon cessation of the squeezing.

3. A dispensable-head toothbrush, comprising:

a. a dispensable toothbrush head having a base member with bristles for brushing teeth, said bristles extending therefrom on a plane perpendicular to a surface of brushing, and having a closed end opposite of an open end on said base, which open end opens into a hollow contoured internal channel of said toothbrush head; and b. a resiliently squeezable toothbrush handle having a first narrow tongue means end and a large end, said tongue means end having a shape to the contour of the hollow contoured internal channel of the toothbrush head, and said tongue means being dimensionally reducible upon a squeezing action at the large end of said handle, which extends from the tongue means, said tongue means being withdrawably insertable into and releasably engageable within the internal channel of the head upon said squeezing action.

4. The toothbrush of claim 3 wherein the handle is made of rigid plastic configured in a U-shape having the U-shape define a core.

5. The toothbrush of claim 4 wherein a resilient material filling is affixed in the core of the U-shape of the handle.

6. The toothbrush of claim 5 wherein said resilient material is squeezable foam.

7. The toothbrush of claim 3 wherein the head and handle are biodegradable.

8. The toothbrush of claim 3 wherein the head is biodegradable.

9. The toothbrush of claim 3 wherein the handle is resiliently squeezable in solely a direction which is parallel to the surface of brushing.

* * * * *